US005168630A

United States Patent [19]

Weber

[11] Patent Number: 5,168,630

[45] Date of Patent: Dec. 8, 1992

[54] BLADE-CARRIER TOOL

[75] Inventor: Bernard H. L. Weber, Villejuif, France

[73] Assignee: Societe Anonyme dite: Rougier-mur-Sol ayant son siege social, France

[21] Appl. No.: 816,295

[22] Filed: Dec. 27, 1991

[51] Int. Cl.[5] ..... B26B 5/00

[52] U.S. Cl. ..... 30/330; 30/125; 30/337

[58] Field of Search ..... 30/337, 338, 339, 125, 30/329, 333, 40, 330

[56] References Cited

U.S. PATENT DOCUMENTS

| | | | |
|---|---|---|---|
| 2,437,928 | 3/1948 | Bennett | 30/338 |
| 2,605,545 | 8/1952 | Weems | 30/337 |
| 3,604,113 | 9/1971 | Cuscovitch | 30/337 |
| 3,685,152 | 8/1972 | Gish | 30/296 |
| 3,845,554 | 11/1974 | Joanis et al. | 30/339 |
| 3,900,950 | 8/1975 | Collins | 30/337 |
| 4,005,525 | 2/1977 | Gringer | 30/125 |
| 4,277,888 | 7/1981 | Szabo | 30/40 |
| 4,391,043 | 7/1983 | Sizemore et al. | 30/330 |
| 4,575,936 | 3/1986 | Gringer | 30/169 |
| 4,662,070 | 5/1987 | Reddig | 30/125 |

FOREIGN PATENT DOCUMENTS 2402521 4/1979 France .

*Primary Examiner*—Frank T. Yost
*Assistant Examiner*—Hwei-Siu Payer
*Attorney, Agent, or Firm*—Marshall, O'Toole, Gerstein, Murray & Bicknell

[57] ABSTRACT

A blade-carrier tool of the type forming a handle for holding in the hand, and provided at its front end with a removable blade which is held in position by a clamping mechanism including two jaws between which the blade may be engaged. The jaws of the clamping mechanism are connected to respective levers serving to control the clamping mechanism. The levers are suitable for occupying an open first position in which the jaws are moved apart from each other, and a closed second position which is spontaneously locked under the action of declutchable locking means, in which position the jaws bear against respective opposite sides of the blade and hold it securely in position.

12 Claims, 4 Drawing Sheets

BLADE-CARRIER TOOL

The present invention relates to a blade-carrier tool intended, for example, for cutting wall or floor coverings such as fitted carpet or the like, or for scraping surfaces, even though other applications could naturally be envisaged.

BACKGROUND OF THE INVENTION

Blade-carrier tools, in particular for cutting floor coverings, comprise a handle for grasping which is generally constituted by two assembled-together half-shells, with a cutter blade being disposed therebetween so that a portion thereof projects from one of their common ends. A clamping mechanism including a screw serves to hold the two half-shells together and consequently to hold the cutter blade in position with the blade thus being pressed on opposite sides by the half-shells.

Although tools of this type are in very widespread use, they nevertheless suffer from the drawback of requiring a screwdriver to be available for opening the handle for the purpose of changing the blade, and subsequently for closing it again in order to hold the new blade in position. Consequently, that requires fiddly disassembly and assembly operations on the screw, and it requires the two half-shells to be fitted together properly before they can be screwed together.

Another type of blade-carrier tool is also known for cutting floor coverings which avoids the need for a screwdriver and in which the two half-shells are moved apart for the purpose of changing a blade and are moved back towards each other for the purpose of holding a new blade in position by means of a screw clamping mechanism provided with a knurled disk disposed in the mean plane common to the two assembled-together half-shells and projecting therefrom. The handle of the tool can thus be opened and closed by acting directly on the knurled disk that is secured to the screw which holds the two half-shells together.

Although that considerably improves the use of such tools, the proper clamping torque is not always applied to the disk to ensure that the handle is closed securely. Thus, if too little clamping torque is applied, there is a danger of the blade slipping suddenly between the two half-shells, and in the application described that can give rise to dangerous and inaccurate cutting of the covering, while if the clamping torque is too great, then the handle can be opened again only by acting on the disk by means of a suitable tool.

An object of the present invention is to remedy the above drawbacks by providing a blade-carrier tool whose clamping mechanism design makes it possible to do without a screwdriver or other similar tool when changing the blade, and makes it possible to open and close said blade-carrier tool automatically.

SUMMARY OF THE INVENTION

To this end, the present invention provides a blade-carrier tool of the type forming a handle for holding in the hand and provided at its front end with a removable blade which is held in position by a clamping mechanism having two jaws between which said blade may be engaged, wherein said jaws of said clamping mechanism are connected to respective levers serving to control said clamping mechanism, which levers are suitable for occupying an open first position in which said jaws are moved apart from each other, and a closed second position which is spontaneously locked under the action of declutchable locking means, in which position said jaws bear against respective opposite sides of said blade and hold it securely in position.

The invention thus makes it possible, merely by acting on the levers, either to move the jaws apart after declutching the locking means, thereby enabling a worn blade to be replaced by a new blade, or else to move the jaws towards each other so that they clamp securely on the new blade, with the levers being spontaneously locked in the closed position by the action of said declutchable locking means.

Consequently, opening and closing the blade-carrier tool does not require the use of a screwdriver or the like and, in addition, the clamping mechanism guarantees a constant clamping torque on each of the blades used.

Advantageously, one of the jaws is a moving jaw being hinged to the corresponding control lever which is capable of taking up either one of said positions, whereas the other jaw is fixed and is secured to the corresponding lever. Thus, an embodiment of the clamping mechanism which is simple while nevertheless retaining the same effectiveness is analogous to a mole wrench, with the mechanism being operated by a single control lever having the moving blade hinged thereto.

In this embodiment, said fixed jaw and said corresponding lever are secured to one another and thus constitute a fixed portion of said handle, whereas said control lever and said moving jaw form a moving portion of said handle.

Preferably, when said control lever is in its closed second position, said lever and said moving jaw are in line with each other, and together with the fixed jaw and its lever, they define a handle whose outside shape is continuous, whereas when the control lever is in its open first position, it forms, together with the moving jaw, a V-shape that projects sideways from the fixed portion of the handle. Thus, when in use with the control lever in its closed position, the outside shape of the blade-carrier tool is harmonious and compact, and is easy to handle.

Further, said control lever and said moving jaw are pivotally mounted about respective first and second parallel axes connected to the handle, said control lever and said moving jaw being hinged to each other via their corresponding edges.

In a preferred embodiment, said declutchable means for locking said control lever in its closed position comprise a rod having one end pivotally mounted on said control lever about a third axis parallel to the preceding axes, and having its other end suitable for pivoting about a hinge point P defined at the rear end of said handle, such that in the closed position of said control lever, the third axis lies on one side of a line L connecting said first axis to said hinge point P, thereby locking said control lever, and when said lever is in its open position the third axis is situated on the other side of said line L moving said moving jaw away from the fixed jaw.

It will thus be understood that the control lever can be moved from one of these positions to the other only by overcoming the maximum force generated by the rod when the first and second axes together with the hinge point are in alignment. The alignment defined in this way thus constitutes a maximum threshold that must be overcome in order to toggle spontaneously from one of the positions of the lever to the other.

Advantageously, said rod is provided with an endpiece screwed onto the rod and terminated by a hemispherical end which engages in a corresponding socket provided at the rear end of the handle and is suitable for pivoting about the hinge point of said socket.

A release mechanism for providing assistance in opening said clamping mechanism may be associated with said handle to declutch said means for locking said control lever. Thus, the above-defined alignment is easily overcome to cause the control lever to toggle from the locked and closed second position to its open first position.

In a particular embodiment, said release mechanism comprises a member pivotally mounted at the rear end of said handle, said member being suitable, on being rotated, for acting via a lug against said control lever to declutch said locking means and to toggle the lever from its spontaneously locked closed position to its open position in which said moving jaw is at a distance from the fixed jaw.

In addition, it is advantageous to provide a supply of blades inside said handle. Preferably, said supply of blades is housed in said control lever with the blades being held in position by at least one magnet. Thus, when the lever is in its open position projecting from the fixed portion of the handle, the supply of blades is easily accessible.

In addition, said blade mounted at the front end of said handle remains associated with one of said jaws when the jaws are moved apart from each other. For example, said blade may be held against said fixed jaw by means of a magnet.

BRIEF DESCRIPTION OF THE DRAWINGS

Embodiments of the invention are described by way of example with reference to the accompanying drawings, in which.

Figure 1:
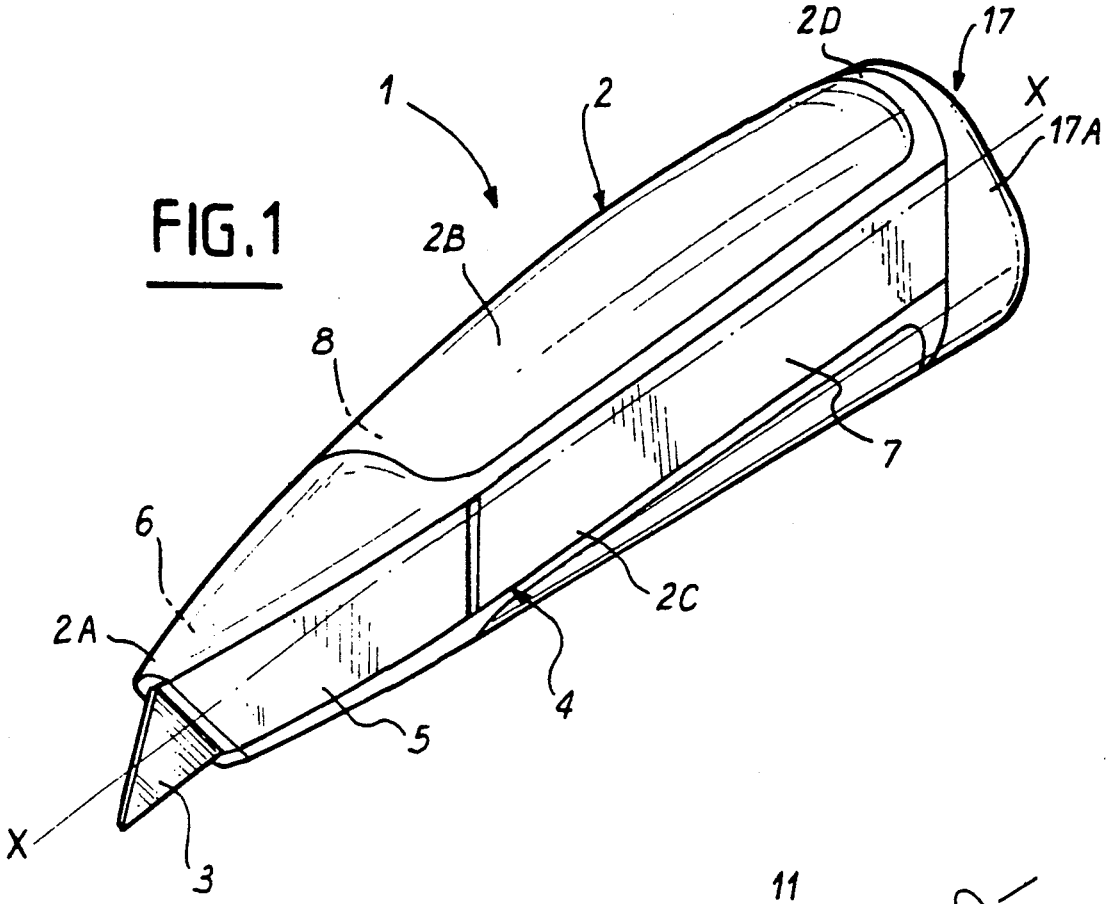
FIG. 1 is a perspective view of an embodiment of the blade-carrier tool of the invention, and more particularly intended for cutting floor or wall coverings, with the clamping mechanism being shown in its closed position for holding the cutter blade in position.

In these figures, identical references designate items that are similar.

DETAILED DESCRIPTION

With reference to FIGS. 1 to 4, the blade-carrier tool 1 shown, which is intended for particular performing cutting operations on floor coverings such as fitted carpet or the like, is of conventional shape, comprising an elongate handle 2 for grasping and provided with a removable cutter blade 3 at its front end 2A, the blade may be trapezium-shaped, for example, and it is held in position in the handle by a clamping mechanism 4.

The clamping mechanism 4 has a hinged pincer-like jaw. As shown more particularly in FIG. 3, it comprises two jaws 5 and 6, with the cutter blade 3 being disposed therebetween, each jaw being connected to a respective lever 7 or 8, with the levers being capable of taking up an open first position (FIG. 6) in which the jaws 5 and 6 are apart from each other, and a closed second position which is spontaneously locked by a toggle action (FIG. 1) in which the jaws press against respective opposite sides of the cutter blade 3, thereby holding it securely in position.

In the embodiment shown, the clamping mechanism 4 is controlled solely by the lever 7 acting on the moving jaw 5 via respective corresponding edges 5A and 7A, while the jaw 6 is fixed relative to its lever 8.

Figure 3:
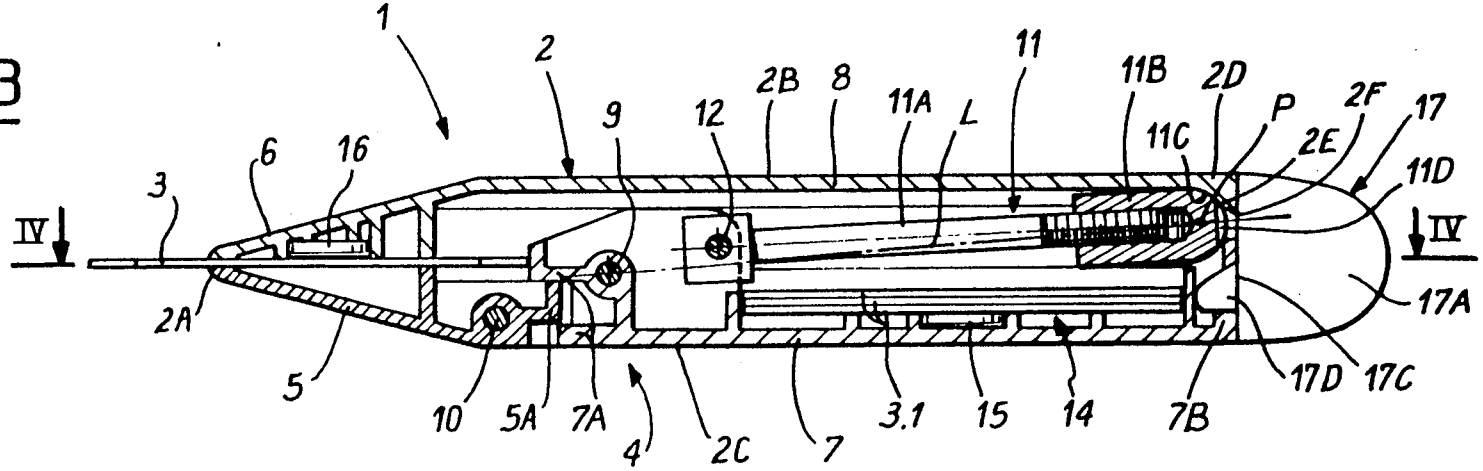
FIG. 3 is a longitudinal section through the tool on line III—III of FIG. 2.

FIG. 3 also shows that the fixed jaw 6 and the lever 8 are integral with each other, the jaw extending from the lever. They advantageously constitute the fixed portion 2B of the handle 2 of said tool. In contrast, the moving jaw 5 (which is similar in shape to the fixed jaw 6) and the control lever 7 together constitute the moving portion 2C of the handle 2.

In FIG. 1, when the control lever 7 occupies the closed second position in which the moving jaw 5 presses the cutter blade 3 against the fixed jaw 6, the lever 7 and its jaw 5 fit smoothly against the fixed portion 2B, such that the blade-carrier tool 1 is easy to handle and, in addition, is harmonious in outline.

Structurally, the control lever 7 and the moving jaw 5 are pivotally mounted about respective first and second axes 9 and 10 that are parallel to each other and orthogonal to the general longitudinal direction X—X of the elongate handle 2, and they co-operate with each other via a hinge defined by their corresponding edges 5A and 7A. In addition, to ensure that the control lever 7 locks spontaneously in its closed position, thereby ensuring that the blade is properly clamped by the jaws 5 and 6, declutchable locking means 11 are provided in said tool. These means 11 connect the lever 7 to the rear or heel end 2D of the handle 2, while being housed therein.

With reference to FIG. 3, it can be seen that the declutchable means 11 comprise a rod 11A having one end pivotally mounted on the lever 7 about a third axis 12 which is parallel to the axes 9 and 10, and has its opposite end provided with an endpiece 11B which is screwed onto the rod 11A. The endpiece 11B is terminated by a hemispherical shape 11C which co-operates with a socket 2E of corresponding shape provided in the end 2D of the fixed portion 2B of the handle 2. A slot 11D is also provided in the hemispherical end 11C of the endpiece (see FIGS. 3 and 5) making it possible by means of a hole 2F formed correspondingly in the end 2D of the handle, to mount the endpiece in the socket 2E and to put the rod under compression by means of a screwdriver.

The rod 11A can thus pivot about the hinge point P defined by the endpiece received in the socket. The third axis 12 is close to the first hinge axis 9 of the control lever. In FIG. 3, the axis 12 about which the rod 11A is hinged to the control lever 7 lies on one side of a line L interconnecting the hinge axis 9 of the lever 7 and the hinge point P. More particularly, the axis 12 is on that side of the line L which is closer to the lever 8, i.e. the fixed portion 2B of the handle 2.

In the position shown in FIG. 3, the locking means 11 are active, i.e. the control lever 7 is in its closed position and the cutter blade is clamped between the jaws 5 and 6. The operation of these locking means is described below.

Figure 4:
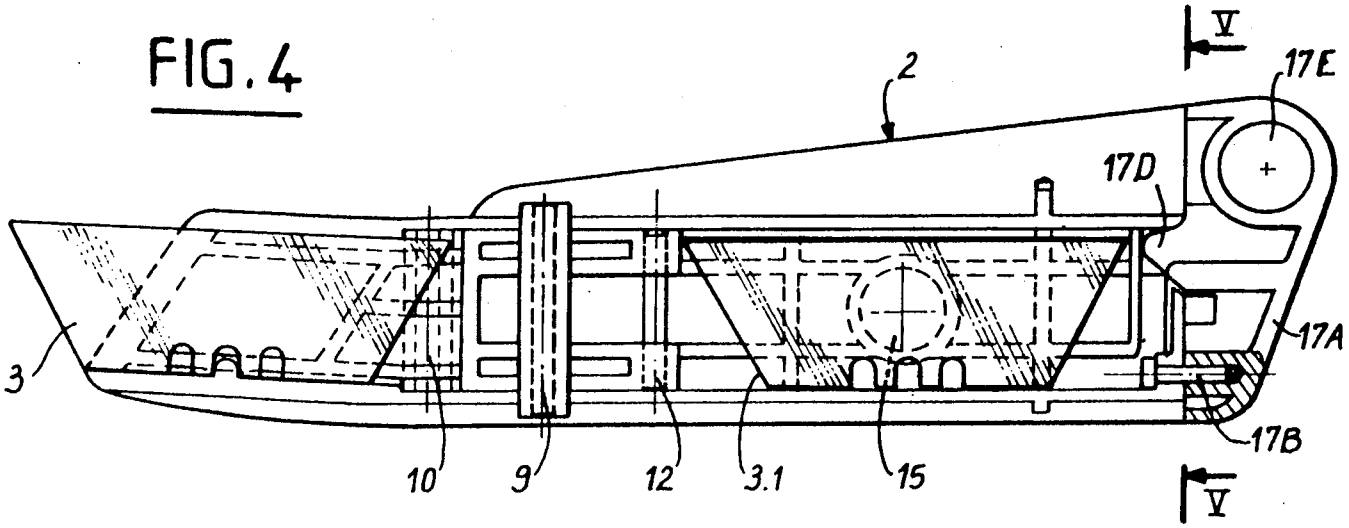
FIG. 4 is a longitudinal section through said tool on line IV—IV of FIG. 3.

In addition, a supply 14 of cutter blades 3.1 is provided inside the handle 2. These cutter blades 3.1 lie against one another and they are advantageously held against the control lever 7 by means of a magnet 15 associated with the lever, as can be seen in FIGS. 3 and 4. Thus, when the control lever occupies its open first position, the spare blades are easily accessible.

Furthermore, the cutter blade 3 remains held in position at the front end 2A of the handle when the jaws are moved apart from each other. In the embodiment shown, a magnet 16 is housed, for example, in the fixed jaw 6 such that when the moving jaw 5 moves away therefrom, the metal cutter blade 3 remains in contact with the fixed jaw 6 under the action of the magnet 16.

The blade-carrier tool 1 of the invention is also provided with a release mechanism 17 for providing assistance in opening said clamping mechanism 4. The mechanism 17 is designed to enable the control lever to toggle from its locked closed position to its open position by simultaneously declutching the locking means 11.

Figure 5:
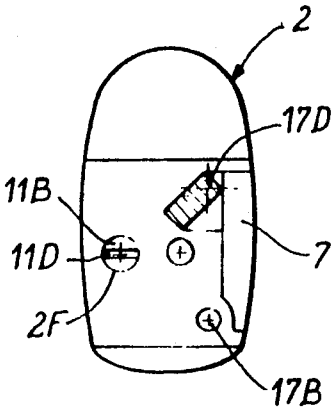
FIG. 5 is a cross-section through said tool on line V—V of FIG. 4.

In the embodiment shown in FIGS. 3 to 5, the release mechanism 17 comprises a member 17A which is rotatably mounted on the rear end or heel 2D of the fixed portion 2B of the handle. This member 17A extends the outside shape of the handle 2 smoothly such that in FIGS. 1 to 5, the member 17A forms a part of the handle.

Structurally, the member 17 is mounted about an axis 17B connected to the end 2D and disposed orthogonally to the axes 9, 10, and 12, and parallel to the general longitudinal direction X—X of the blade-carrier tool 1. Its face 17C which is in contact with the end 2D is provided with a lug 17D which projects into the handle and comes substantially into contact with an inside edge 7B of the control lever 7 (FIG. 5).

In addition, an eye 17E may optionally be provided through the member 17A for the purpose of fastening the tool.

Figure 2:
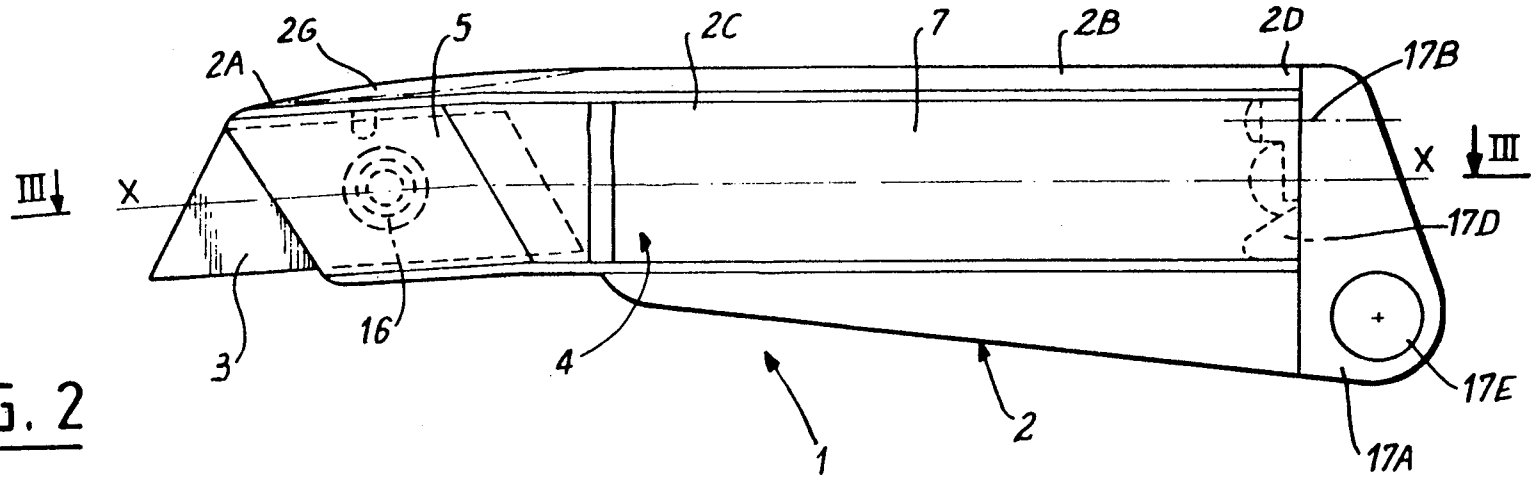
FIG. 2 is an elevation view of the blade-carrier tool shown in FIG. 1.

As can be seen more particularly in FIGS. 2 and 4, the general longitudinal direction X—X of said tool slopes slightly towards its front end 2A so that the cutting edge 3A of the blade is inclined at an angle of a few degrees, thereby facilitating cutting operations. With reference to FIG. 2, a dent 2G may be provided on the top of the handle towards its front end to make it easier for an operator to hold the handle.

The clamping mechanism 4 of said tool operates as follows.

It is assumed that initially the blade-carrier tool 1 is in its configuration as shown in FIGS. 1 to 5 and that the operator desires, for example, to change a cutter blade 3 whose edge 3A is worn.

Figure 6:
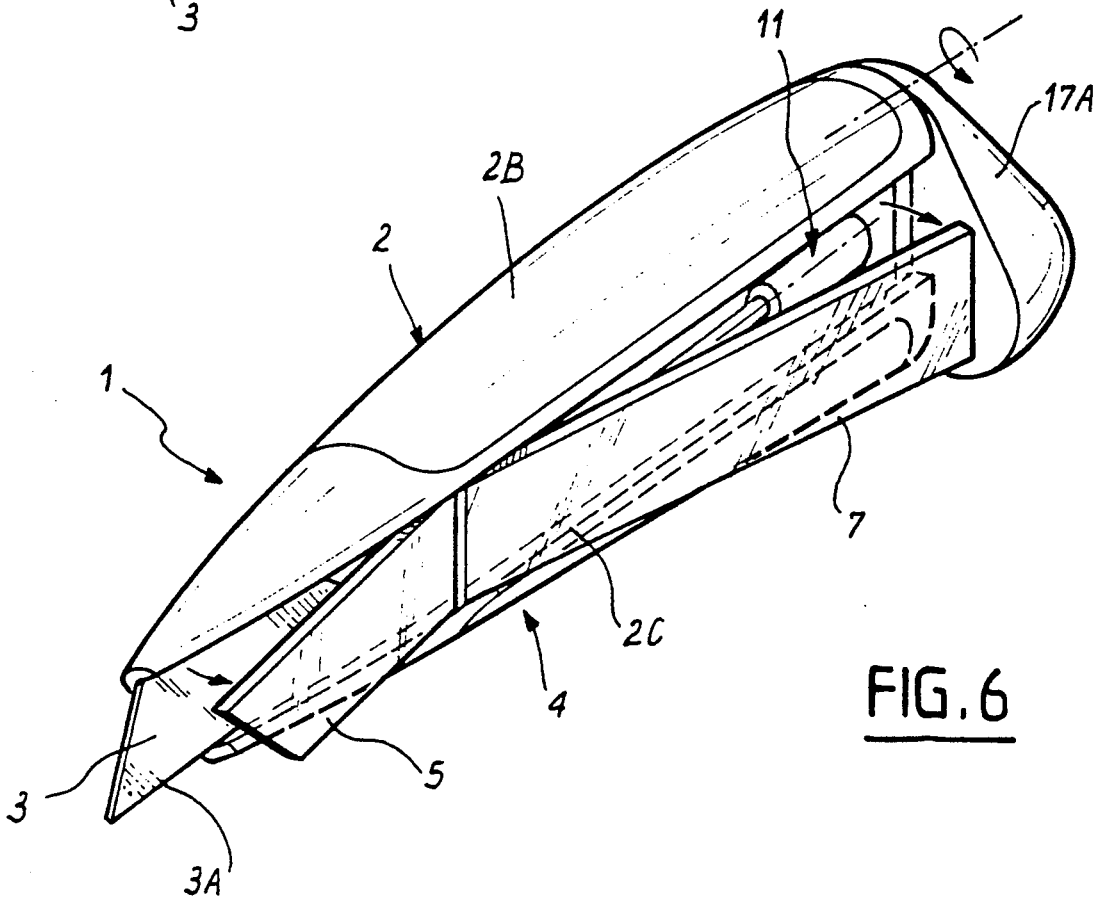
FIG. 6 is a perspective view of the tool of the invention showing said clamping mechanism in its open position which in this application enables the cutter blade to be changed.
Figure 7:
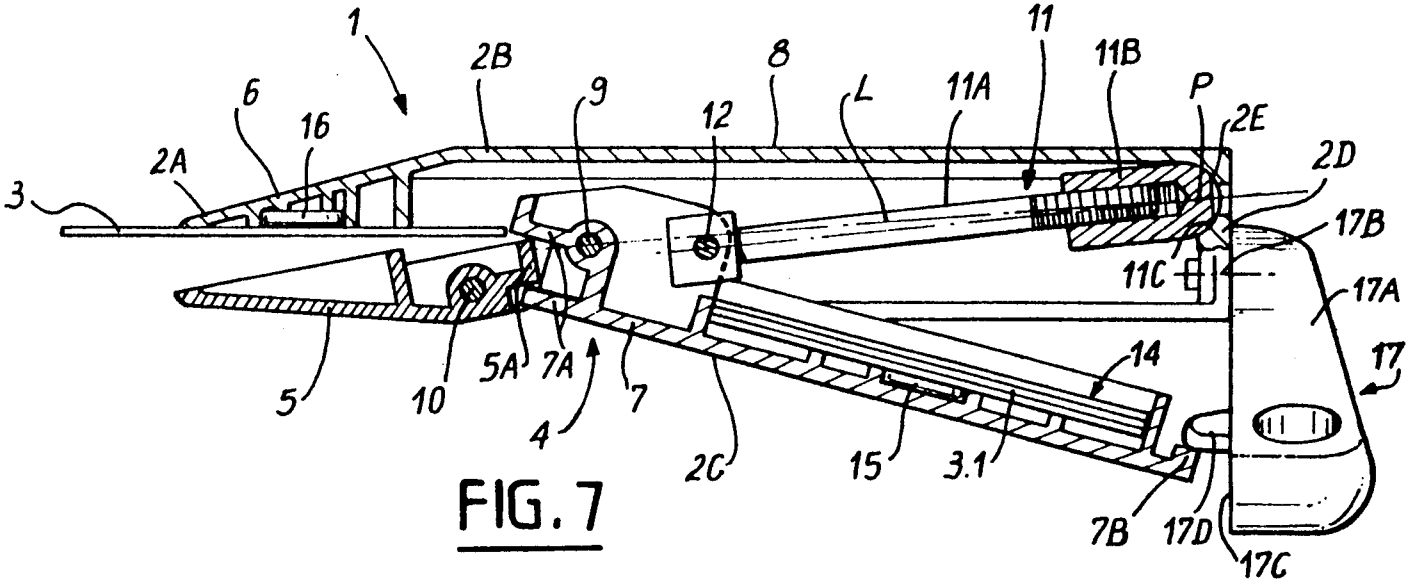
FIG. 7 is a longitudinal section through the tool analogous to the section of FIG. 3, but showing the clamping mechanism in its open position under drive from the release mechanism for giving assistance in opening.

To do this, the operator acts on the rotary member 17A of the release mechanism 17. With reference more particularly to FIGS. 6 and 7, the rotary member 17A pivots about the axis 17B which is connected to the fixed portion 2B of the handle 2. Its lug 17D bears against the edge 7B of the control lever, thereby beginning to pivot the control lever about its fixed hinge axis 9 at its end opposite to the edge 7B. Simultaneously, the hinge axis 12 connecting the rod 11A to the lever 7 is rotated about the fixed axis 9 such that the rod 11A pivots about the point P by means of its hemispherical endpiece co-operating with the socket 2E of the fixed portion 2B.

As the axis 12 moves towards the above-defined line L, the operator acting on the rotary member "feels" stiffness corresponding to the maximum force exerted by the rod 11A when it lies on the line L, however this situation is mechanically unstable since the axes 9 and 12 and the point P are in alignment.

By continuing to rotate the member 17A, the operator overcomes the maximum force so that the third hinge axis 12 goes past the line L and lies on the other side thereof. At this moment, the clamping mechanism 4 opens easily in the direction shown by the arrows since the locking means 11 are then declutched and inactive. Simultaneously with the control lever 7 moving from its closed position to its open position by pivoting about its fixed axis 9, the moving jaw 5 pivots about its fixed axis 10 because of the action of the edge 7A of the lever 7 on the corresponding edge 5A of the moving jaw 5. It may be observed that the edge 7A of the lever forms a fork with the corresponding edge 5A of the moving jaw being received between the prongs of the fork such that regardless of whether the lever is opening or closing, the edge 5A of the jaw comes into contact with one or other of the prongs of the fork defining the edge 7A of the lever.

The open first position of the clamping mechanism 4 is shown in FIGS. 6 and 7. The lever 7 and the jaw 5 then take up a V-configuration, both projecting from the fixed portion 2B of the handle. Because of the action of the magnet 16, the worn blade 3 remains in contact with the fixed jaw 6. The operator can then easily remove the blade 3 and replace it with a new spare blade 3.1 stored in the supply 14 provided in the control lever 7. After the new cutter blade 3.1 has been put into position on the fixed jaw 6, the operator can then act on the lever 7 to return the clamping mechanism 4 to its closed position as shown in FIGS. 1 and 3, which position is spontaneously locked by the locking means 11 when the hinge axis 12 of the rod is returned to the other side of the line L. The lever 7 and the jaw 5 are thus automatically brought back into alignment under drive from the locking means 11. As it returns to the closed position, the edge 7B of the lever which remains in contact with the lug 17D returns the release member 17A to its initial position by pivoting it about the axis 17B.

The jaws 5 and 6 then firmly clamp the new blade in place while exerting a constant force thereon.

Figure 8:
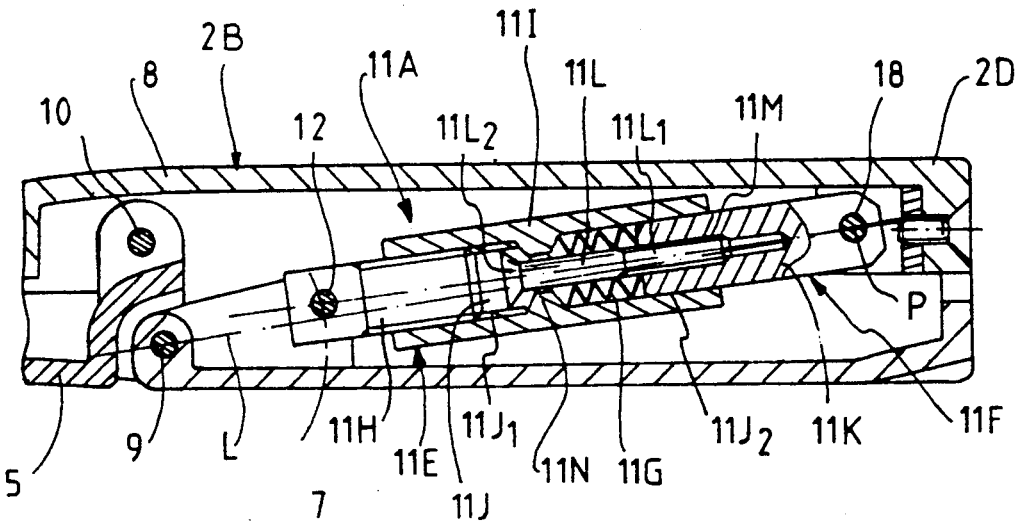
FIG. 8 is a fragmentary longitudinal section through the tool analogous to the section of FIG. 3, but showing a variant embodiment of said declutchable locking means.

In a variant embodiment shown in FIG. 8, the rod 11A of the declutchable locking means 11 is longitudinally resilient instead of being axially rigid once its length has been adjusted by screwing the endpiece 11B on the rod 11A, i.e. its length between the third axis 12 and the point P.

In the case shown in FIG. 8, the rod 11A comprises two rod portions, a first portion 11E and a second portion 11F which are capable of sliding relative to each other and which have resilient means 11G disposed therebetween.

More particularly, the first rod portion 11E is constituted by a threaded endpiece 11H pivotally mounted about the third axis 12 which is connected to the lever, and by a hollow cylindrical sleeve 11I whose open axial passage 11J is screwed at one end via internal tapping $11J_1$ onto the threaded endpiece 11H. The second rod portion 11F comprises a cylindrical endpiece 11K pivotally mounted on the rear end 2D of the handle about a fourth axis 18 extending parallel to the third axis and passing through the above-defined point P. The endpiece 11K is received in the smooth-walled end $11J_2$ of the axial passage 11J in said sleeve, and a screw 11L has its threaded portion $11L_1$ screwed home into an axial tapped hole 11M provided in said endpiece 11K. The screw 11L thus emerges from the endpiece 11K inside said sleeve 11I and its head $11L_2$ is situated beyond an inside shoulder 11N provided in the axial passage of said sleeve, approximately in the middle thereof, inbetween the tapped wall $11J_1$ and the smooth wall $11J_2$ of said axial passage.

It can thus be seen in FIG. 8 that the head $11L_2$ of the screw is situated between the endpiece 11H and the shoulder 11N of the sleeve which forms the first rod portion 11E. The resilient means 11G are disposed between the endpiece 11K and said shoulder 11N about the emerging shank portion 11L of the screw, which resilient means may be constituted, for example, by an appropriate stack of spring washers.

As shown in FIG. 8, the declutchable locking means 11 are active so that the control lever 7 is in its closed position, thereby causing the blade to be clamped between the jaws. The axis 12 lies behind the line L now extending between the fixed axes 9 and 18, i.e. it lies on the same side thereof as the fixed portion 2B of the handle. Thus, the effect of the spring washers 11G is to urge the first and second portions 11E and 11F of the rod 11A coaxially apart from each other, and it is advantageous for said portions to be constantly urged against their respective axes 12 and 18, thereby guaranteeing that the said control lever 7 is effectively maintained in its closed position.

This variant embodiment of said declutchable locking means also facilitates opening the control lever 7 and thus opening the moving jaw 5 relative to the fixed jaw, and vice versa it facilitates closing said control lever, and thus also closing the moving jaw. Because of the "telescopic" structure of the rod 11A made possible by the use of spring washers, the length of the rod 11A between the moving third axis 12 and the fixed fourth axis 18 varies as a function of the circular path followed by the moving axis 12 about the fixed first axis 9 during declutching or locking of the locking means and corresponding respectively to opening or closing said lever 7. The displacement stroke between the two portions of the rod 11A as made possible by the action of the spring washers 11G can itself be adjusted by tightening or loosening the sleeve 11I on the endpiece 11H, thereby moving the annular shoulder 11N towards or away from the head $11L_2$ of the screw which is secured to the endpiece 11K, said screw head $11L_2$ defining an axial abutment which limits the maximum displacement stroke of the rod.

It should also be understood that both the angle to which the lever opens relative to the fixed portion 2B of the tool, and simultaneously the angle to which the moving jaw 5 opens, are then greater than the corresponding angles in the preceding embodiment, thereby making it easier to change the cutter blade. In addition, this embodiment does not require release means to facilitate opening said tool.

I claim:

1. A blade-carrier tool comprising a handle for holding in a user's hand, a clamping mechanism at one end of said handle adapted to hold a removable blade, said mechanism including two jaws between which said blade may be clamped, said jaws of said clamping mechanism being connected to respective control levers serving to control said clamping mechanism, said levers being adapted to occupy an open first position in which said jaws are spaced from each other, and a closed second position in which said jaws bear against respective opposite sides of said blade and hold it securely in position, locking means for selectively locking said control lever of said moving jaw in its closed second position, said locking means being declutchable to permit movement of said control lever of said moving jaw to its open first position, one of said jaws being a moving jaw hinged to its respective control lever which is capable of occupying either of said positions, the other jaw being fixed and secured to its respective lever, said moving jaw and its respective control lever being pivotally mounted about respective second and first parallel axes connected to the handle, said moving jaw and its respective control lever being hinged to each other via their corresponding edges.

2. A tool according to claim 1, wherein said fixed jaw and said its control lever are secured to each other and constitute a fixed portion of said handle, whereas said control lever and said moving jaw form a moving portion of said handle.

3. A tool according to claim 2, wherein, when said control lever of said moving jaw is in its closed second position, said control lever and said moving jaw are in line with each other and together with the fixed jaw and its lever, they define a handle whose outside shape is continuous, whereas when the control lever of said moving jaw is in its open first position, it forms, together with the moving jaw, a V-shape that projects sideways from the fixed portion of the handle.

4. A tool according to claim 1, wherein said declutchable means for locking said control lever of said moving jaw in its closed position comprise a rod having one end pivotally mounted on said control lever about a third axis parallel to said first and second axes, and having its other end suitable for pivoting about a hinge point defined at the rear end of said handle, such that in the closed position of said control lever, the third axis lies on one side of a line connecting said first axis to said hinge point, thereby locking said control lever, and when said lever is in its open position the third axis is situated on the other side of said line moving said moving jaw away from the fixed jaw.

5. A tool according to claim 4, wherein said rod is provided with an endpiece screwed onto the rod and terminated by a hemispherical end which engages in a corresponding socket provided at the rear end of the handle and is suitable for pivoting about said hinge point.

6. A tool according to claim 4, wherein said rod is longitudinally resilient and comprises first and second coaxial portions slidably mounted relative to each other with resilient means being disposed therebetween tending to move them apart, said first portion being pivotally mounted on said control lever of said moving jaw about said third axis, while said second portion of the rod is pivotally mounted to the end of said handle about a fourth axis parallel to the third axis and including said point.

7. A tool according to claim 1, wherein a release mechanism for providing assistance in opening said clamping mechanism is associated with said handle to declutch said locking means for locking said control lever of said moving jaw.

8. A tool according to claim 7, wherein said release mechanism comprises a member pivotally mounted at the rear end of said handle, said member being suitable, on being rotated, for acting via a lug against said control lever of said moving jaw to declutch said locking means and to toggle said control lever from its spontaneously locked closed position to its open position in which said moving jaw is at a distance from the fixed jaw.

9. A tool according to claim 1, wherein a supply of blades is provided in said handle.

10. A tool according to claim 9, wherein said supply of blades is housed in said control lever of said moving jaw with the blades being held in position by at least one magnet.

11. A tool according to claim 1, wherein said blade mounted at the front end of said handle remains associated with one of said jaws when the jaws are moved apart from each other.

12. A tool according to claim 11, wherein said blade is held against said fixed jaw by means of a magnet.

* * * * *